US005120295A

United States Patent [19]

Mosse

[11] Patent Number: 5,120,295

[45] Date of Patent: Jun. 9, 1992

[54] APPARATU FOR ERECTING TUBULAR CARTON BLANKS

[75] Inventor: Richard W. E. Mosse, London, England

[73] Assignee: Tetra Pak Holdings SA, Pully, Switzerland

[21] Appl. No.: 599,807

[22] Filed: Oct. 22, 1990

[30] Foreign Application Priority Data

Oct. 26, 1989 [GB] United Kingdom ..... 8924079

[51] Int. Cl.[5] ..... B31B 1/52

[52] U.S. Cl. ..... 493/313; 493/181; 493/182; 493/310; 493/317

[58] Field of Search ..... 493/313, 314, 315, 316, 493/317, 318, 319, 309, 310, 180, 182, 181; 53/457, 458, 564, 566

[56] References Cited

U.S. PATENT DOCUMENTS 2,289,820 7/1942 Ardell .
2,612,823 10/1952 Woelfer .
2,827,838 3/1958 Pearson et al. .
3,062,106 11/1962 Pearson et al. .
3,293,998 12/1966 Farnow ..... 493/310
3,504,596 4/1970 Hirasuna ..... 493/313 X
4,057,008 11/1977 Hughes ..... 493/313 X
4,109,444 8/1978 Lee ..... 493/316 X
4,846,777 7/1989 Aiuola et al. ..... 493/317

FOREIGN PATENT DOCUMENTS 326980 2/1958 Switzerland .

*Primary Examiner*—Bruce M. Kisliuk
*Assistant Examiner*—John A. Marlott
*Attorney, Agent, or Firm*—Nixon & Vanderhye

[57] ABSTRACT

Apparatus is provided for erecting tubular carton blanks from a flattened to an open tubular state and includes two blank erection stations positioned sequentially along a conveyor for conveying a succession of blanks to the stations. In each station a suction head is attached to a blank and moves the blank through a cycle from a blank collection position, through a blank lifting phase, then through a blank erecting phase in which the blank is pressed against an abutment member into force the blank to an erected condition. When the suction head reaches a blank releasing position, suction head is returned. The suction heads are carried by a link arm driven in a parallel movement by cams via pivot arms.

15 Claims, 5 Drawing Sheets

APPARATU FOR ERECTING TUBULAR CARTON BLANKS

The present invention relates to apparatus for erecting tubular carton blanks from a flattened to an open tubular state.

U.S. Pat. No. 3,783,752 describes apparatus for erecting tubular carton blanks carried on an endless conveyor from a magazine. The blanks suction head carried by the conveyor and by a second suction head carried on a rotating arm at an erecting station and are pulled open as the suction heads move apart. Only one erecting station is provided. For feeding a high speed packaging machine, it is desirable to be able to erect two or more blanks simultaneously. Also, it is undesirable to have to provide suction heads moving with the conveyor because this involves complex vacuum distribution arrangements and the use of rotary air seals which are liable to need frequent maintenance.

In EP-A-0117537, apparatus for erecting two blanks at a time is described in which, in each of two blank erecting stations disposed along an upper run of an endless conveyor, arms lift blanks from the conveyor and erect the blanks whilst the conveyor runs continuously. Blanks to be fed to the more downstream of the two stations pass through the more upstream station untouched by the erecting arms. The mechanism provided in each erecting station is complex and involves a number of spring biassed pivoting arms. Each pivot is a potential site for wear. It would be desirable to devise a simpler mechanism of use in each erecting station.

The present invention provides apparatus for erecting tubular carton blanks from a flattened to an open tubular state comprising at least two stations for the erecting of blanks, a conveyor member for conveying a succession of blanks to the said stations, the said stations being positioned successively along a portion of the run of said conveyor member, and carton blank erecting means in each said station operable in use initially to lift a blank from said conveyor member and subsequently to erect the blank, wherein said carton blank erecting means comprises at least one suction head for attachment by suction to a said blank in use and means for moving said suction head through a cycle of movement from a blank collection position, through a blank lifting phase, then through a blank erecting phase and to a blank releasing position and back to said blank collecting position.

Preferably, there is at least one abutment means in each said station against which in use blanks are pressed by movement of said suction heads to erect said blanks.

It is desirable that each blank being erected is lifted from the conveyor member at an early stage in the erection process so that the conveyor member is free to convey further blanks through into the erecting station early in the erection cycle.

Preferably therefore, the or each suction head in each station moves in said lifting phase substantially directly away from said conveyor member to lift a collected blank therefrom and moves in said erecting phase in a path having components in both a first direction away from said conveyor member and a second direction at right angles to said first direction and at right angles to the axis of said tubular blank in use.

This may be contrasted with the erection cycle in EP-A-0117537, in which each blank is first rotated about a trailing edge which lies on the conveyor. The trailing edge is then picked up by one arm of the erecting mechanism and the trailing edge of the blank and the arm carrying it do not clear the path of the conveyor until late in the cycle.

In both U.S. Pat. No. 3,783,752 and EP-A-117537, the erecting of each blank depends in part on continued engagement of the blank with the conveyor to move with the conveyor through at least part of the erecting cycle. In accordance with the present invention, the blanks are lifted from the conveyor member prior to being erected. Thus, in the illustrative embodiments described hereinafter, although the blank does not move in the conveyor member feed direction during the erecting process, the conveyor member is nevertheless free to convey a fresh blank through or to each station whilst a blank is being erected in that station.

Said carton blank erecting means may further comprise an abutment member positioned above the path followed by a blank in reaching the respective erecting station but in the path followed by a blank during said erecting phase in use and upstream from the or each suction head in said second direction, whereby the abutment member limits movement of a blank as a whole in said direction during the blank erecting phase of said suction head movement.

Preferably, said abutment member has a first abutment portion against which in use a blank is restrained during the blank erecting phase and a second abutment portion against which a respective corner of an erected blank sits when in the position to which the blank is carried when the or each said suction head reaches said blank releasing position.

It is desirable that as the blank is opened, it is forced past a rectangular section configuration (i.e. a fully open state) to a parallelogram cross-section state so that when it is released it relaxes to a more truly rectangular cross-section than it would if it were only taken as far as fully open state.

To do this, the means for moving the suction head in each station may be such as to move the suction head past the blank releasing position whilst the blank bears against an abutment member and then to return the suction head to the blank releasing position for releasing the blank. The abutment member may take the form of a pivoting plate against which bears the leading face of the blank.

Alternatively, a movable abutment member may be provided in each station in the path of the blank against which the blank bears before the suction head reaches the blank releasing postion, means being provided to withdraw said movable abutment to allow the blank to relax to a fully open configuration. Suitably, the movable abutment is moved out of the path of the blank by engagement of the abutment or a carrier therefor with displacing means moving with said suction head.

Preferably, in each said station there is further provided a second abutment member so placed that a corner of a blank diagonally opposite to said respective corner lodges against the second abutment member when an erected blank is in the position to which it is carried when the or each said suction head reaches said blank releasing position.

The suction heads may be carried by an elongate link member mounted to execute a parallel motion in which it moves in the said first and second directions.

The link member may be articulated to each of a pair of pivot arms which in turn are mounted to rotate about parallel axes which are equally spaced from the articulation of their respective pivot arm to the link member, and said means for moving the suction head o the or each station may act to rock said pivot arms in sychrony.

Said sychronous rocking may be brought about by the provision of a second link arm connecting said pivot arms to form a parallelogram linkage.

More preferably shafts upon which the pivot arms are mounted are driven in a rocking motion by drive belts, drive chains or gear trains in a sychronised manner.

The or each suction head in each station may instead be carried by a or a respective pivot arm mounted for rotation about an axis parallel to the axis of a tubular blank during erection thereof and said means for moving the or each suction head may act to rock the or each pivot arm.

Preferably the pivot arms mounting the respective suction heads of the plurality of blank erecting stations are moved in sychrony by said moving means.

Each suction head may comprise one or more suction cups.

Preferably two or three suction cups are provided extending along the length of a respective blank in use.

The conveyor member may be an endless conveyor, e.g. a chain conveyor or a vacuum belt conveyor having vacuum ports in the upper face thereof. It is preferably provided with upstanding abutment members, each for engaging the trailing edge of a blank in use. The apparatus may further comprise at least one magazine for holding a stack of said flattened blanks, the or each said magazine having a mouth adjacent said conveyor from which in use the blanks may be taken one at a time by engagement by said conveyor abutment members.

The invention includes a packing machine for receiving a supply of flattened tubular blanks, erecting such blanks, forming bottom end closures, filling said blanks and forming top end closures, which machine includes apparatus for erecting the blanks as described above.

The invention will be further illustrated by the following description of a preferred embodiment with reference to the accompanying drawings in which.

Figure 1:
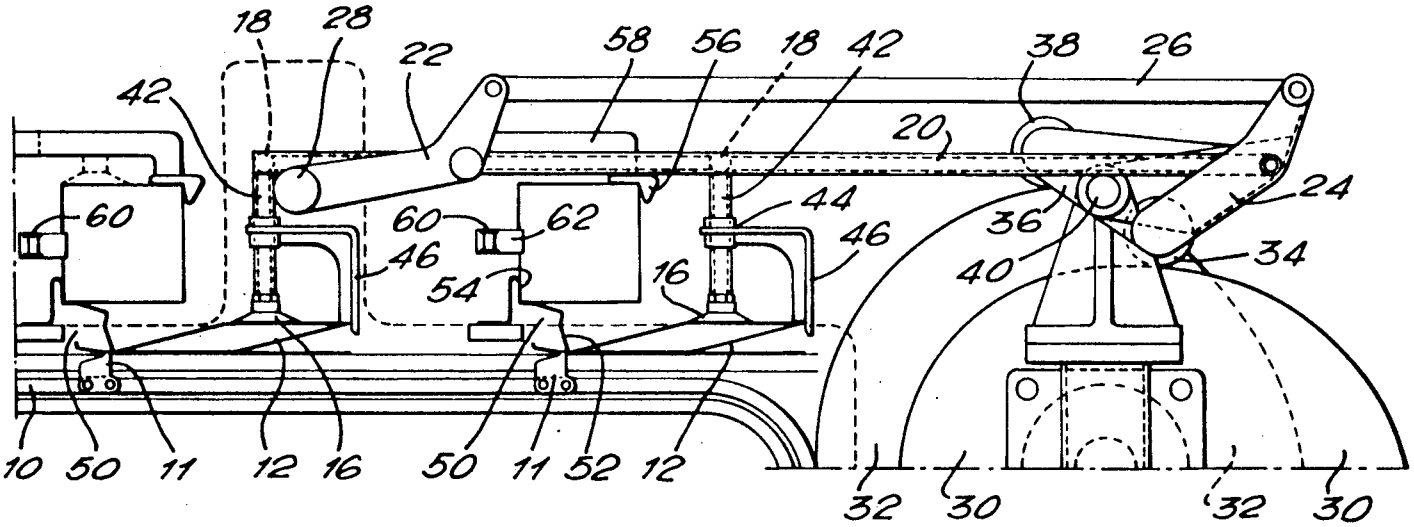
FIG. 1 is a side elevation of apparatus according to a first preferred embodiment.
Figure 2:
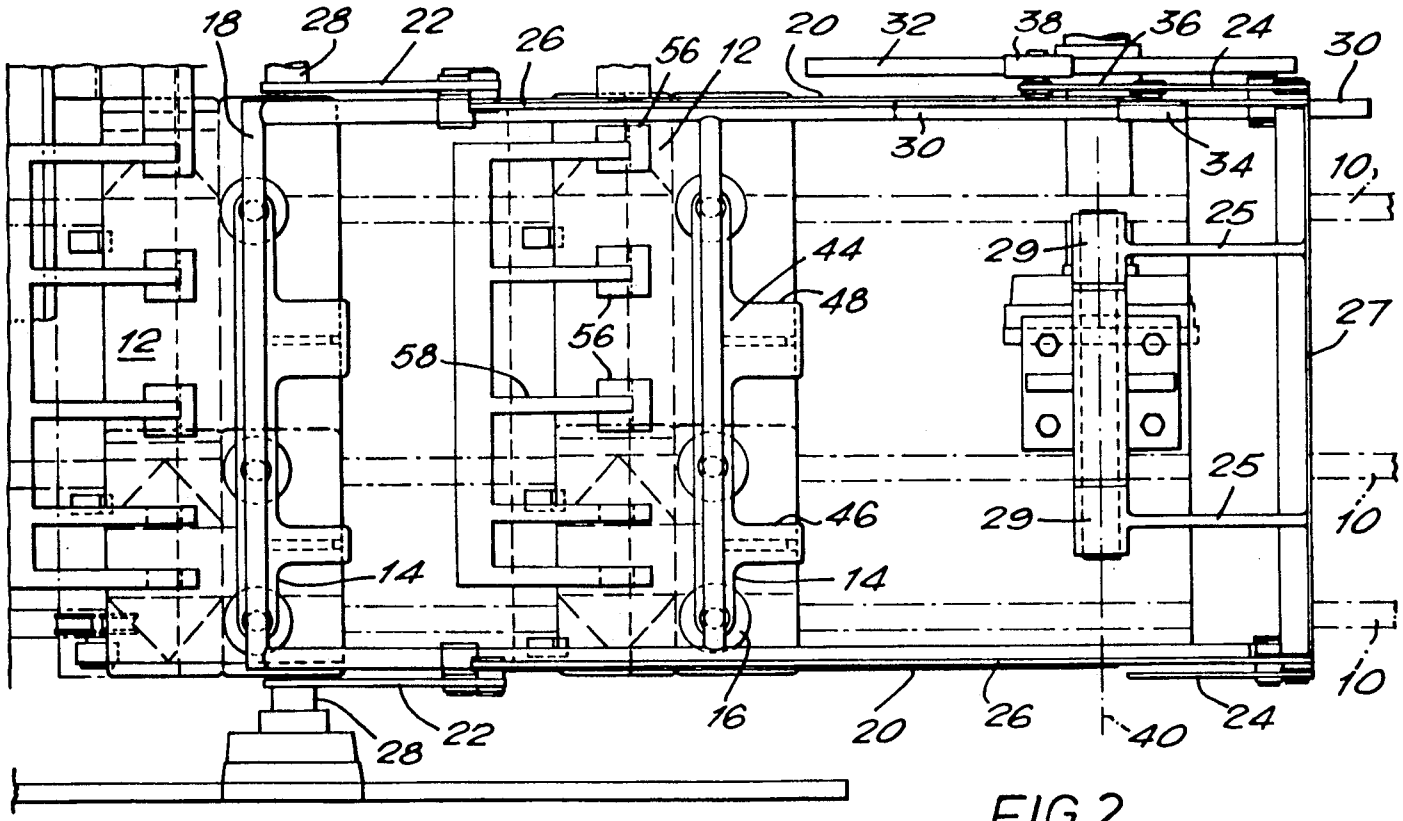
FIG. 2 is a plan view of apparatus of FIG. 1.

In FIG. 1, an endless chain conveyor 10 runs along a generally horizontal path over a portion of its length. The conveyor 10, as seen in FIG. 2 is made up of a trio of parallel running chains which extend in width over a sufficient distance to support the length of tubular carton blanks 12. The longer carton blanks extend across all three chains of the chain conveyor 10. Shorter carton blanks extend across only the lower of the two chains shown in FIG. 2. Each chain carries a series of aligned abutment members in the form of dogs 11.

The apparatus includes a pair of suction heads 14 each of which carries three suction cups 16 arranged to extend across the width of the chain conveyor 10 and so spaced that two suction cups 16 will be positioned to attach themselves even when a carton blank extends across only two chains of the chain conveyor 10.

A controllable source of vacuum (not shown) is provided for operating the suction cups 16.

The suction cups 16 are carried by cross-arms 18 which bridge between a pair of elongate link members in the form of link arms 20. The link arms 20 in turn extend between respective pairs of pivot arms 22 and 24.

The parallelogram linkage is completed by a second elongate link arm 26 extending between each pair of pivot arms 22, 24 and vertically overlying the first elongate link arm 20 on each side of the chain conveyor.

The left hand pair of pivot arms 22 are pivoted about an axis defined by a pair of axles 28 whilst the right hand pair of pivot arms 24 are guided for pivoting motion by a cam and cam follower arrangement. An outboard cam 32 and an inboard cam 30 are mounted below one pivot arm 24 for rotation about a fixed axis parallel to that defined by axles 28. A cam follower roller 34 follows the periphery of cam 30 whilst a cam follower roller 38 follows the periphery of cam 32. Cam follower roller 34 is mounted to the free end of one link arm 24. The other end of the pivot arm 24 is connected both to the link arm 26 and to a cross member 27 of bent sheet metal which is supported on pivot arms 25 which in turn are mounted to rotate around stub shafts 29. Cross member 27 transmits motion of the driven pivot arm 24 to the corresponding arm 24 on the other side of the apparatus. A lever arm 36 which is connected fast with the link arm 24 carrying the roller 34 carries the cam follower roller 38 which rides on the outer periphery of the cam 32. Lever arm 36 is pivoted about a fixed axis 40.

The distance between the axis 40 and the end of the pivot arm 24 at its attachment to the second elongate link arm 26 is equal to the distance between the axis defined by the axles 28 and the attachment of the second link arm 26 to the pivot arm 22 so that rotation about the axis 40 forced by the engagement of the cam followers 34 and 38 with their respective cams produces a parallel motion of the arms 18 rising away from the surface of the chain conveyor 10 as the arms 24 and 22 move anti-clockwise.

Each suction cup 16 is attached to its respective cross-arm 18 by a downwardly extending tube 42. A bridge member 44 spans each set of three tubes 42 and carries a pair of L-shaped bracket members 46 and 48 which extend first to the right away from the tubes 42 and then downwardly towards the surface of the chain conveyor 10.

In each of the carton erecting stations there are provided a stop or abutment member 50 immediately above the surface of the chain conveyor but sufficiently clear of the surface that blanks can pass underneath to reach the erecting stations. Stops 50 each provide a first abutment portion 52 which, in elevation as shown in FIG. 1, lines up with the operating surface of each abutment member of the chain conveyor and also provide a second abutment portion 54 which is disposed upwards and leftwards of the abutment portion 52.

A corner is provided between the abutment portion 54 and a surface connecting the abutment portion 54 to the abutment portion 52.

A diagonally oppositely disposed corner is provided by an L-shaped second abutment member 56 carried on an arm 58 fixed to the supporting framework of the apparatus. In each station, three stops 50 and L-shaped members 56 are provided disposed along the width of the conveyor member.

In each erecting station, a transversely running chain conveyor 60 is arranged having abutment members 62 for removing erected blanks from the apparatus.

In operation, flattened tubular carton blanks are stripped from the mouth of a magazine by the abutment members 11 of the chain conveyor at a location to the left of what is shown in FIG. 1 and the flattened blanks are carried on the surface of the chain conveyor 10 to the apparatus illustrated. The chain conveyor 10 is halted momentarily at the position shown in FIG. 1 and at this point the pivot arms 22 and 24 are pivoted somewhat more clockwise than is shown in FIG. 1. The suction cups 16 attach themselves to the right hand half of each tubular blank. Rotation of the cams 30 and 32 causes the pivot arms 22 and 24 to move anticlockwise about their pivots 28 and 40 to the position shown in FIG. 1. The motion of the tubes 42 carrying the suction cups 16 at this point is substantially vertical and the effect is to lift the tubular carton blanks off the surface of the chain conveyor to the position shown in FIG. 1 where they are just clearing the abutment members 11 of the chain conveyor. A slight opening of the tubular carton blank only is produced during this movement. Once the position shown in FIG. 1 has been passed, the chain conveyor 10 is free to move without disturbing the carton blanks attached to the suction cups 16 and the chain conveyor may then commence to bring further carton blanks in a flattened condition into the erecting station.

Further rotation of the cams 30 and 32 produces further anti-clockwise rotation of the pivot arms 22 and 24 bringing the lower left hand corner of each carton blank gradually up the abutment portion 52 provided on the stop 50 whilst the carton blank is gradually erected by the leftward and upward motion of its suction cup 16. When in the fully erect position, the carton blank is brought up against the abutment portion 54 of the stop 50 and is slipped under the L-shaped member 56. It may now be disengaged by the suction cups 16 and left nesting between the diagonally opposed corners provided by the stop 50 and the L-shaped member 56. The transversely running chain conveyor 60 may then remove the erected blank sideways from the apparatus by moving the blank in its lengthwise direction transverse to the chain conveyor 10. Further rotation of the cams 30 and 32 then return the pivot arms 22 and 24 and hence the suction cups 16 back to their respective start positions to pick up a further blank.

The L-shaped bracket members 46 serve to guide the corner of the tubular blank opposite to that engaged against the abutment members 11 of the chain conveyor and later the stop 50.

Figure 3:
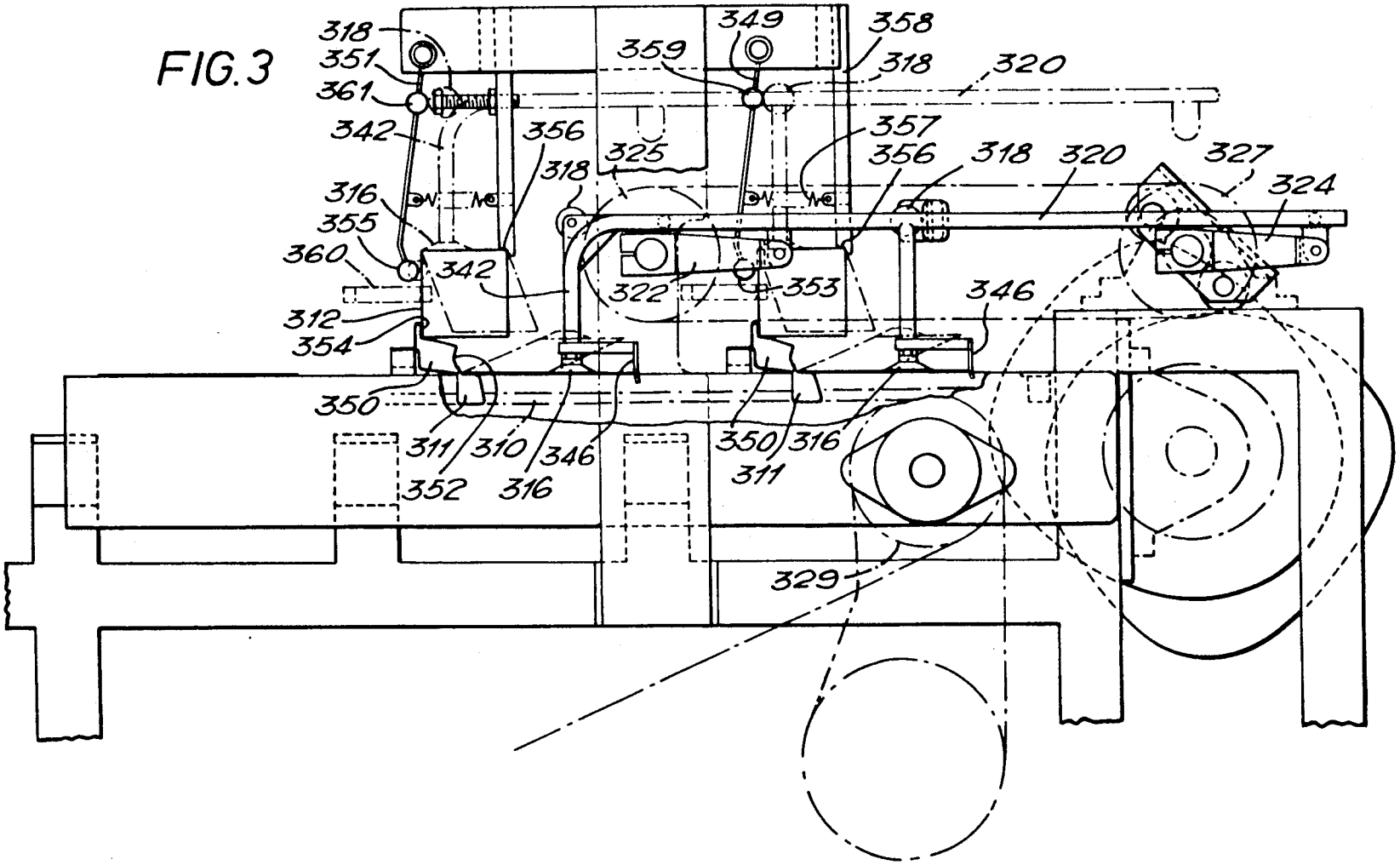
FIG. 3 is a side elevation of a modified form of apparatus constituting a second embodiment.
Figure 4:
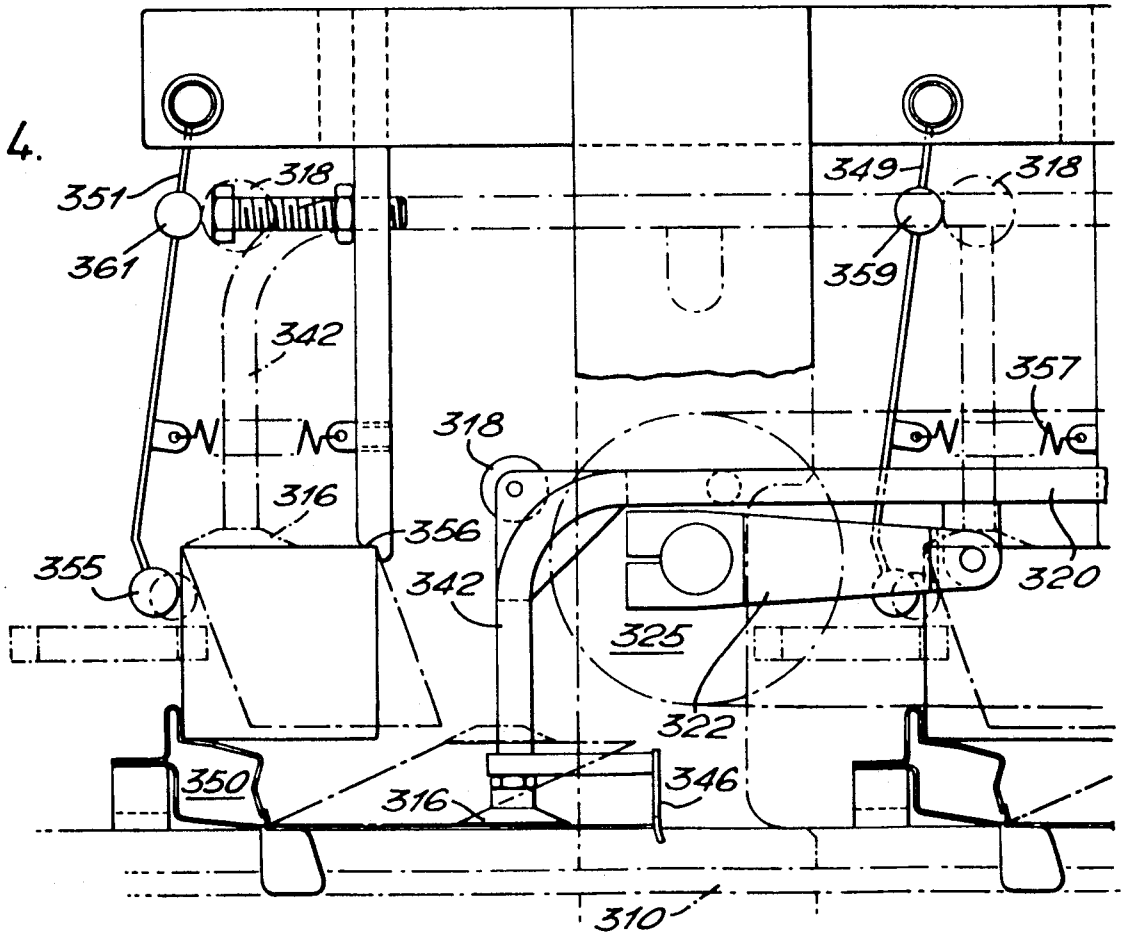
FIG. 4 is an enlargement of the central portion of FIG. 3.

A further preferred embodiment is illustrated in FIGS. 3 and 4. The arrangement shown in FIG. 3 is generally similar to that shown in FIG. 1 and it will be sufficient to describe the principal differences. Parts serving the same function as corresponding parts illustrated in FIG. 1 are given the same reference numeral prefixed by the numeral 3.

The second elongate link arm 26 is omitted and the pivot arms 322 and 324 pivot about shafts upon which are mounted pulleys 325 and 327. Each of these is connected by a toothed belt (not shown) to a drive pulley 329 which is itself driven by a toothed belt in a rocking motion which is communicated to each of the pulleys 325 and 327 and hence to the pivot arms 322 and 324. The rocking motion of the drive to the pulley 329 may be produced by any suitable conventional means. The pulley 329 may be replaced by a roller gear oscillating drive in which a continuously rotating input is transformed into an oscillating rotary output through the engagement of a closed wormlike cam engaged by a follower member extending transversely from the oscillating rotary output shaft.

It is desirable to break each carton sleeve past its square form into a diamond configuration and to allow it to relax back to its square form thereafter. This facilitates loading the sleeve on to a mandrel at a later stage and enables one to make better top and bottom seals. This is achieved in the apparatus shown in FIG. 3 by the provision of arms 349, 351 mounted for rotation on tranversely extending shafts mounted in the superstructure of the apparatus and each extending downwards to terminate in a ball 353, 355. Instead of one arm 349 and one arm 351, one may have two or more such arms lying parallel to one another in each station spaced transversely across the width of the machine and the balls 353 and 355 may be replaced by shafts linking the arms in each group.

Each arm is spring loaded by a spring 357 towards the position occupied by an erected carton. A further ball or cross-shaft 359, 361 is provided on each arm or group of arms just below the pivot mounting of the arm or arms and serves to engage against the cross-shafts 318 positioned above each suction cup 316.

In use, the balls or shafts 353, 355 bear against the side walls of the respective carton blanks in each station as the blank reaches its erected position, breaking the blank past its fully rectangular state. The arms 349 and 351 are then deflected away from the blank by the engagement between the balls or shafts 359, 361 and the cross-shafts 318 allowing the blank to relax back to a rectangular configuration as it becomes lodged between the members 350 and 356 prior to removal by the chain conveyor 360. The movement of the arms 349, 351 can of course be obtained by other means other than that illustrated.

A similar mechanism for breaking each blank past its rectangular configuration may be incorporated in the embodiment of FIG. 2.

Figure 5:
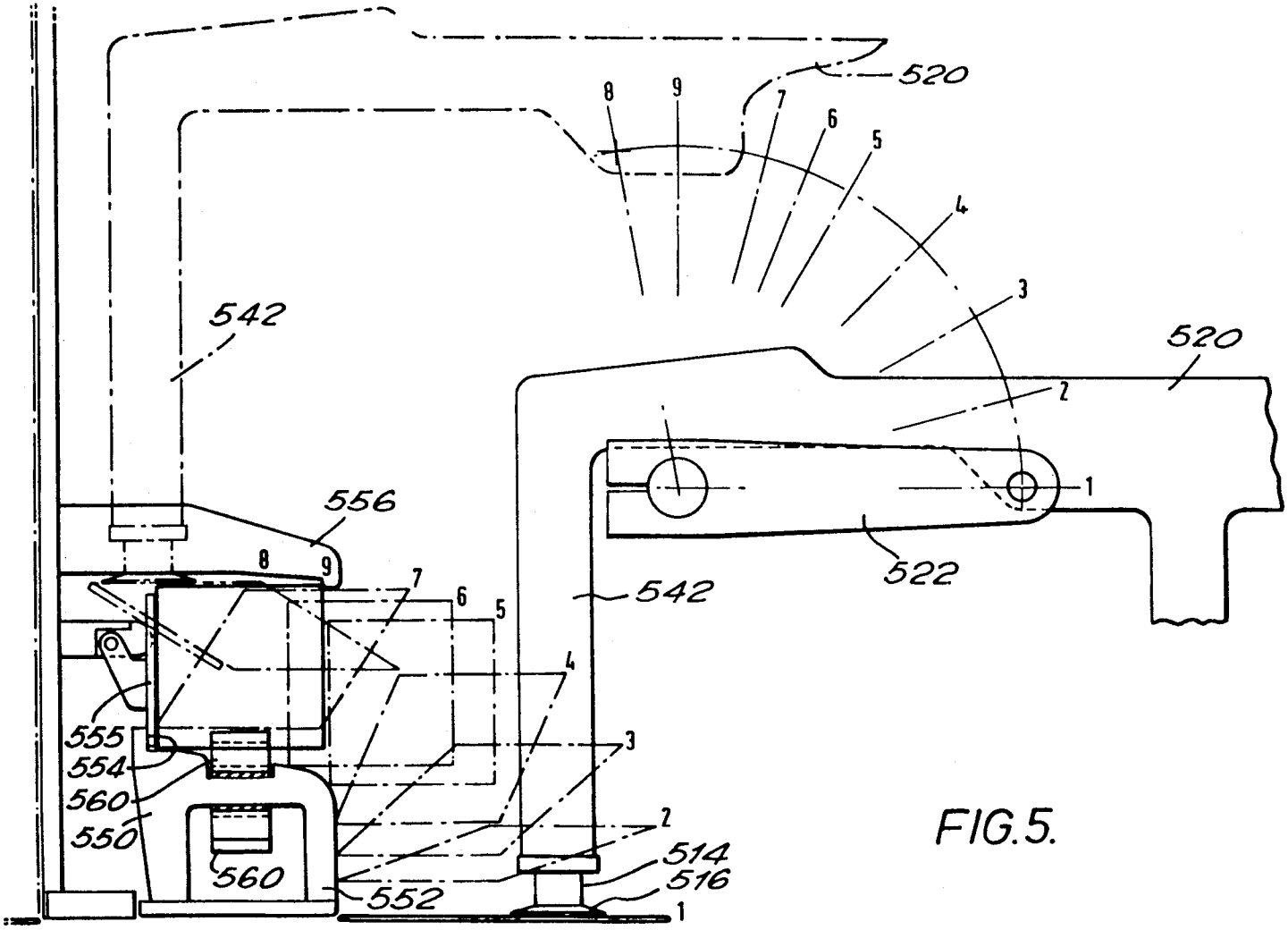
FIG. 5 shows in side elevation an erecting station of a third embodiment.

In FIG. 5, parts equivalent to those described with reference to FIG. 1 are given the same reference numeral prefixed by the numeral '5'. The mechanism for the movement of the suction head is generally as in FIGS. 3 and 4, save as follows.

In the alternative embodiment illustrated in FIG. 5, a different mechanism is employed for breaking each carton sleeve past its square form into a diamond or parallelogram configuration and to allow it to relax back to its square form thereafter. Associated with the fixed abutment member 550 is a tilting abutment plate 555 which comprises a plate member carried on a pair of arms extending at right angles to one face thereof, which arms are pivoted about a horizontal axis running crosswise of the machine. In its normal position, the plate of the abutment 555 lies in a vertical plane with its bottom edge bearing against the abutment portion 554 of the fixed abutment 550. The oscillation of the pivot arms (of which 552 is shown) is extended past the vertical position marked by the numeral 9 which corresponds with the blank releasing position by about 10° to a position marked 8. This has the effect of carrying the suction head and its attached blank past the blank releasing position so that the leading face of the blank during this movement bears against the plate of the abutment member 555. The blank is broken past its fully open position into a diamond configuration and the plate 555 tilts to maintain its contact against the leading face of the blank.

The pivot arm 552 is then returned to the position 9 corresponding to the blank releasing position of the suction head and at this point suction is cut off releasing the opened carton sleeve blank in the blank releasing position where it is held between the abutment member 550 and the abutment member 556. Once again, a similar mechanism for breaking each blank past its rectangular configuration may be incorporated in the embodiment of FIG. 2.

It may be noted in FIG. 5 that the transversely running conveyor 560 is arranged to lie beneath the erected blank in the blank releasing position rather than to one side of it as in FIGS. 1 and 3.

Whilst the present invention has been described with refrence to the features of the preferred embodiments illustrated, many modifications and variations thereof are possible within the scope of the invention. For instance to assist in initiating the opening of the carton blank produced by the initial upward movement of the suction cups 316, suction means may be provided to hold down the bottom surface of the blank on to the chain conveyor momentarily. This helps to ensure that the subsequent pressure exerted between the suction cup 16, 316 and the member 50, 350 produces opening of the carton blank and not deformation of the blank into an L-configuration.

The suction between the suction means provided beneath the chain conveyor and the blank may be broken either by the upward movement of the blank itself or by the operation of suitable valve means to poison the vacuum in the suction means at an appropriate stage actuated either mechanically or electrically.

The suction means may comprise either elastomer mouldings working with a vacuum pump or slots underlying the chain conveyor surface through which a partial pressure obtained from a fan or a venturi device is made to grip the underside of each blank at the start of the erection cycle. Alternatively, it may consist of a hollow conveyor belt with upstanding lugs and apertures on its outer face, air being pumped continuously from the interior of the belt to provide suction through said apertures to hold blanks on to the belt. The lugs on the belt surface take the place of the dogs 11 in FIG. 1. A belt conveyor of this type is also shown employed as the conveyor 560 in FIG. 5.

I claim:

1. Apparatus for erecting tubular carton blanks from a flattened to an open tubular state comprising at least two stations for the erecting of blanks, a conveyor member for conveying a succession of blanks to the said stations, the said stations being positioned successively along a portion of the run of said conveyor member, and carton blank erecting means in each said station operable initially to lift the entirety of a blank from said conveyor member and subsequently to erect the blank, wherein said carton blank erecting means comprises a suction head for attachment by suction to a said blank and means for moving said suction head through a cycle of movement from a blank collection position, through a blank lifting phase, then through a blank erecting phase and to a blank releasing position and back to said blank collecting position.

2. Apparatus as claimed in claim 1, wherein there is at least one abutment member in each said station against which abutment members in use blanks are pressed by movement of said suction heads to erect said blanks.

3. Apparatus as claimed in claim 1, wherein said means for moving said suction head is such that said suction head in each station moves in said lifting phase substantially directly away from said conveyor member to lift a collected blank therefrom, and moves in said erecting phase in a path having components in both a first direction away from said conveyor member and a second direction at right angles to said first direction and at right angles to an axis which connects the centers of the open ends of said tubular blank.

4. Apparatus as claimed in claim 3, wherein said carton blank erecting means further comprises an abutment member in each station positioned in the path followed by a blank during said erecting phase in use and upstream from the suction head in said second direction, whereby the abutment member limits movement of a blank as a whole in said directions during the blank erecting phase of said suction head movement.

5. Apparatus as claimed in claim 4, wherein said abutment member has a first abutment portion against which in use a blank is restrained during the blank erecting phase and a second abutment portion against which a respective corner of an erected blank sits when in the position to which the blank is carried when the said suction head reaches said blank releasing position.

6. Apparatus as claimed in claim 5, wherein in each said station there is further provided a second abutment member so placed that a corner of a blank diagonally opposite to said respective corner lodges against said second abutment member when an erected blank is in the position to which it is carried when the suction head reaches said blank releasing position.

7. Apparatus as claimed in claims 3, wherein each suction head is carried by an elongate link member mounted to execute a parallel motion in which it moves in said first and second directions.

8. Apparatus as claimed in claim 7, wherein said link member is articulated to each of a pair of pivot arms which axes in turn are mounted to rotate about parallel axes which axes are equally spaced from the articulation of their respective pivot arms to the link member, and wherein said means for moving the suction head of the station acts to rock said pivot arms in synchrony.

9. Apparatus as claimed in claim 2, wherein the suction head in each station is carried by a pivot arm mounted for rotation about an axis parallel to an axis which connects the centers of the open ends of a tubular blank during erection thereof and wherein said means for moving the suction head acts to rock the pivot arm.

10. Apparatus as claimed in claim 9, wherein the pivot arms mounting the respective suction heads of the plurality of blank erecting stations are moved in synchrony by said moving means.

11. Apparatus as claimed in claim 1, wherein each suction head comprises at least one suction cup.

12. Apparatus as claimed in claim 1, wherein said conveyor member is an endless conveyor.

13. Apparatus as claimed in claim 12, wherein said endless conveyor is a chain conveyor.

14. Apparatus as claimed in claim 12, wherein said endless conveyor has upstanding abutment members thereon for engaging the trailing edge of a blank in use.

15. Apparatus as claimed in claim 1, wherein the means for moving the suction head in each station is such as to move the suction head through and past the blank releasing postion, abutment means being provided to bear against the leading face of said blank in said movement past the blank releasing position whereby to open said blank past the fully open configuration, and said means for moving the suction head is such as to then return the suction head to the blank releasing position to release the blank.

* * * * *